United States Patent [19]

Young

[11] Patent Number: 4,875,458

[45] Date of Patent: Oct. 24, 1989

[54] SHOOTING TAB

[76] Inventor: Lloyd L. Young, Rte. 2, E. Hiway 50, Sedalia, Mo. 65301

[21] Appl. No.: 297,135

[22] Filed: Jan. 11, 1989

[51] Int. Cl.[4] ..... F41B 5/00

[52] U.S. Cl. ..... 124/35 A; 124/23 R

[58] Field of Search ..... 124/35 A, 23 R, 24 R, 124/86; 2/161 A, 161 R, 168

[56] References Cited

U.S. PATENT DOCUMENTS

| | | | |
|---|---|---|---|
| 3,151,333 | 10/1964 | Scholz | 2/161 R |
| 3,362,027 | 1/1968 | Petrov | 2/161 A |
| 3,438,630 | 4/1969 | Petti | 2/161 A |
| 3,608,090 | 9/1971 | Wilson | 124/35.2 |
| 3,665,911 | 5/1972 | Altier | 124/35.2 |
| 4,620,524 | 11/1986 | Saunders | 124/35.2 |

OTHER PUBLICATIONS

Neet Products, Inc. Catalog 1988, p. 19.

*Primary Examiner*—Randolph A. Reese
*Assistant Examiner*—Anthony Knight
*Attorney, Agent, or Firm*—Head & Johnson

[57] ABSTRACT

A shooting tab for use with a bow having a string for shooting arrows which includes a tab facing with an arrow notch. The front of the tab facing which contacts the bow string is provided with a plurality of ridges so that there is a sixty-two percent less contact with the bow string than previously.

9 Claims, 2 Drawing Sheets

SHOOTING TAB

BACKGROUND OF THE INVENTION

This invention relates to an improved shooting tab for use with a bow having a string for shooting an arrow.

For centuries man has been using bow and arrows in hunting for food, in battle and sometimes as a game in target practice. These bow and arrows can take on many forms but they essentially consist of a bow back and a bow string connected between the ends of the back. Various types of arrows have been used with the bow. At first the arrow was used simply with the bow string and bow with the archer placing the bow string in the nook of the arrow and pulling back and then releasing the string. Since that use many improvements have been made to the bow and arrow shooting art. One of the more important improvements from the primitive bow and arrow is the advent of the shooting tab. A shooting tab includes a tab facing with an arrow notch therein attached to a finger loop with a finger hole therein. In use, the archer places his "tall man" finger in the hole, places the arrow through the notch and wraps his fingers and the tab facing about the bow string. The tab facing has a front which is smooth. This smooth surface contacts the bow string. The archer then pulls the bow string back to the desired tension and then releases his fingers and the bow string slides off the front of the tab facing as it is released. The tension on the bow string propels the arrow through the air. This type of shooting tab has been around for some time and has been used by literally hundreds of thousands of archers.

It is an object of this invention to provide a shooting tab which will provide a smoother and quicker release of the bow string for improved efficiency and accuracy of shooting.

SUMMARY OF THE INVENTION

This is an improvement in shooting tabs which are used with a bow having a bow back and a bow string for shooting arrows. The shooting tab includes a finger loop or a finger hole. The shooting tab also includes a novel tab facing which contacts the bow string when in operation. The facing has a front, a back and an arrow notch which is aligned with a finger spacer which is normally provided. In a preferred embodiment, the front (which contacts the bow string) of the facing has a plurality of raised ribs which are essentially parallel to the notch when the facing is flat. In operation, the bow string extends essentially perpendicular across these ridges. The surface area of the front of the facing which is exposed to or contacts the bow string when used is greatly reduced from the prior shooting tabs. Preferably, the rib size is such that contact area is reduced as much as sixty-two percent from what the string contact would be if there were no ridges and the front of the facing was smooth as is in the prior art. Several of these new improved shooting tabs with my improved facing front have been made and it has been found that they are much improved over the old models. My shooting tabs give a smoother, faster easier release of the bow string which gives real improvement to the shooting. My new improved shooting tab has been tested by several expert archers and they have all agreed that it is a vast improvement and gives faster and easier releases.

DETAILED DESCRIPTION

Figure 1:
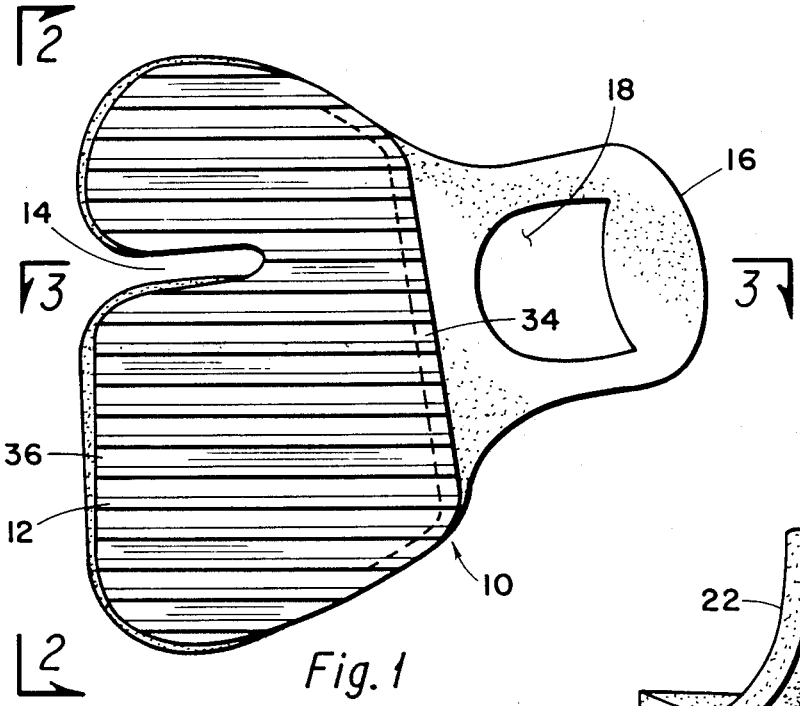
FIG. 1 is a plane elevational view of the finger loop and the front of the facing of my improved shooting tab.

Attention is first directed to FIG. 1 which is a plane view of the front of the tab facing 10 and finger loop 16. The tab facing is made of a flexible material and is preferably a waterproof vinyl such as urethne vinyl. The front of the tab facing 10 includes a plurality of ribs 12 which are essentially parallel to the longitudinal axis of notch 14. Attached to or made a part of the tab facing 10 is a finger loop 16 having finger hole 18.

Figure 3:
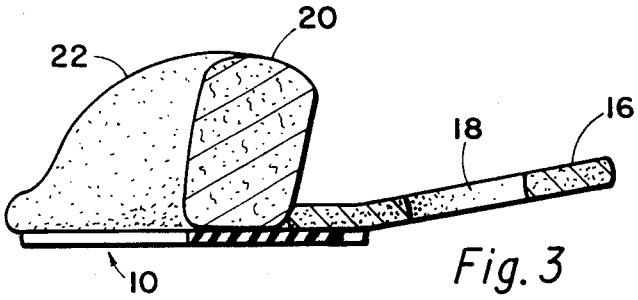
FIG. 3 is a view taken along the line 3—3 of FIG. 1.
Figure 2:
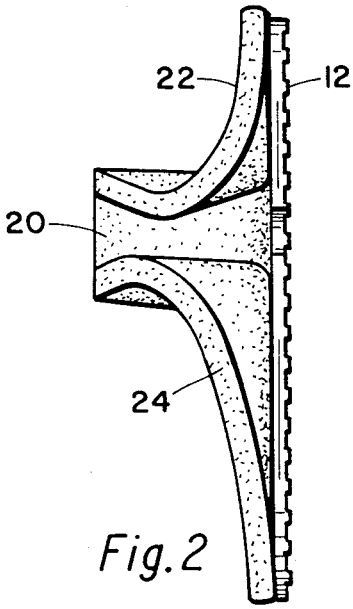
FIG. 2 is a view taken along the line 2—2 of FIG. 1.

In a preferred shooting tab there is a finger spacer 20 as shown in FIGS. 2 and 3. Finger spacers have been used for many years and are used to keep the fingers from pinching the arrow. Pinching the arrow interferes with the arrow flight and also irritates the fingers. An upper backing 22 extends from finger spacer 20 to the top of tab facing 10 and a lower backing 24 extends from the other side of finger spacer 20 to the other end of tab facing 10. This is illustrated clearly in FIG. 2. The upper backing 22 and lower backing 24 is frequently made of a soft, pliable, flexible material such as felt. The finger spacer 20 is preferably made of solid rubber but may be made of a soft five-sixteenth inch thick felt.t Attention is now briefly directed to FIGS. 4 and 5 to show how the shooting tab is applied. Shown thereon a bow string 26 is grasped by a hand using the shooting tab shown in FIGS. 1, 2 and 3. The nook end 28 of an arrow extends through notch 14 and along finger spacer 20 so that the end of the notch in the end of the arrow is held against the bow string 26. The fletching 30 of the arrow is shown. With the shooting tab, the arrow and the bow string in the position shown in FIGS. 4 and 5, the archer is then ready to pull back on the bow string 26 until he reaches the appropriate extension. The archer can then release the bow string to shoot the arrow.

Figure 5:
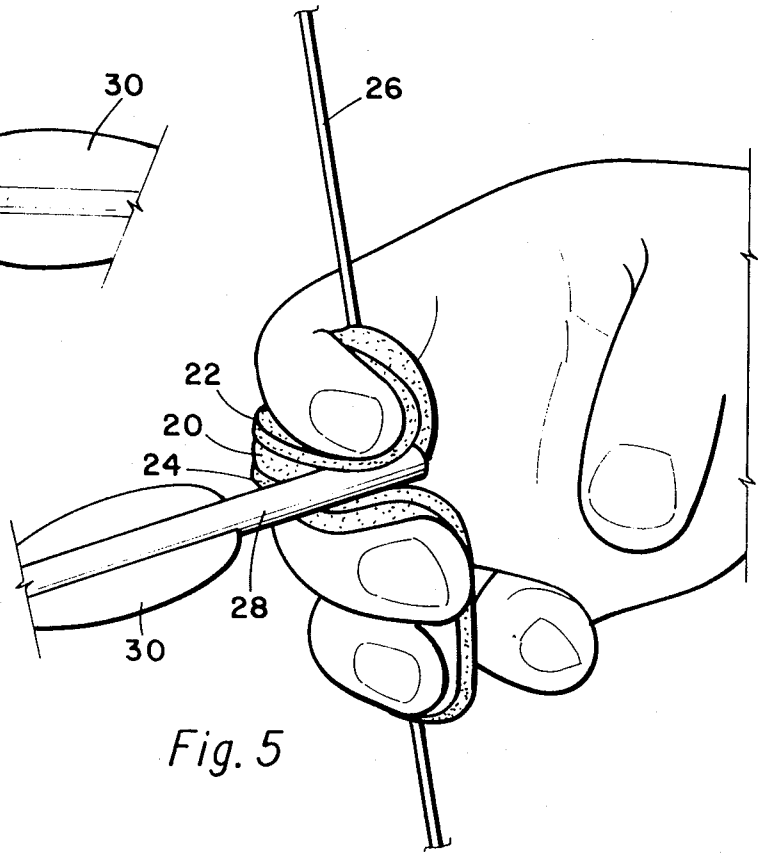
FIG. 5 is similar to FIG. 4 except that it shows the other side of the hand of FIG. 4.
Figure 4:
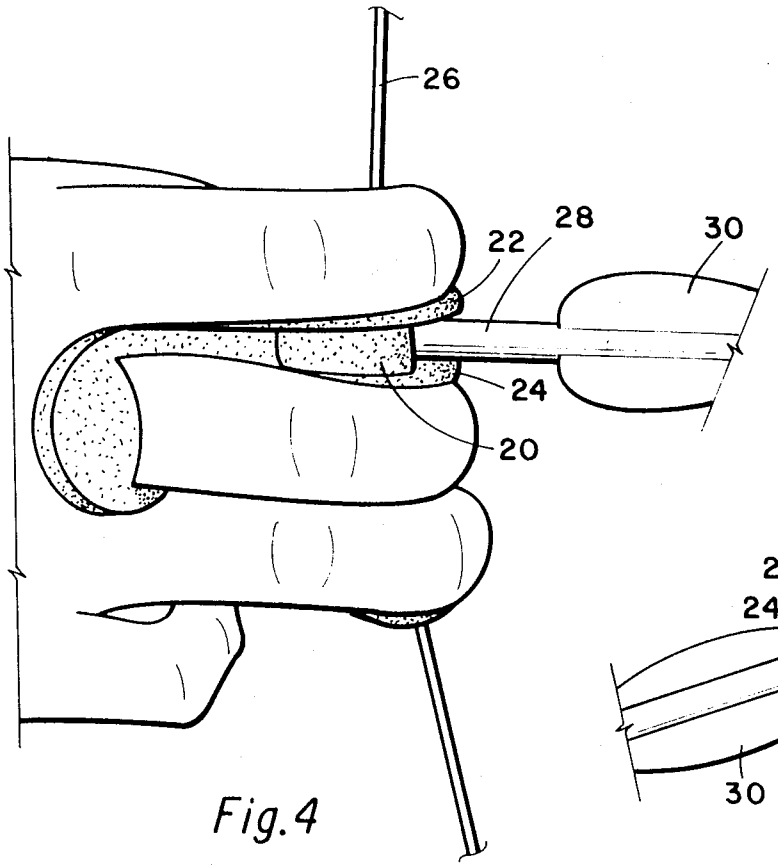
FIG. 4 illustrates the back of a hand with a shooting tab operating on a bow string.

I have created a shooting tab which is durable, slick, flexible, waterproof and as friction-free as possible. My design greatly reduces the friction between the bow string and the tab facing. By using the ribs 12 I greatly reduce the contact of the bow string 26 with the front of tab facing 10. As seen in FIGS. 4 and 5, the bow string 26 is substantially perpendicular to the ribs 12. By my arrangement and my improvement there is less string contact with the front of tab facing 10. It has been found that there is less friction, and that there is a smoother, faster and easier release of the bow string 26. This, of course, produces an improved shooting operation thus improving accuracy and speed of the arrow once released.

In a preferred embodiment which I have made, the front or side face is a molded urethane vinyl with a release agent and has an overall thickness of 0.035 inches. The surface of the ribs 12 which contacts the bow string 26 has been reduced by about sixty-two percent from the one hundred percent contact of the string with a smooth front of the tab facing of the prior shooting tabs. This was accomplished by having the ribs approximately one-sixteenth inches wide (that part of the rib which contacts the bow string 26), and about 0.035 inches thick. The ribs were 3/32 inches apart (edge to edge). This space between the ribs can be called a valley and is about 0.025 inches thick. The ribs rise about 0.010 inches above the valley. This model has proven to have all the advantages listed above and has been accepted by all of the expert archerymen who have tested it. The contact surface of the ribs 12 should preferably be in a range of not over about forty to fifty percent of the total area of the face of the tab facing for best results. It is believed that any ribbing would improve the bow string release due to the valleys between the ribs.

I have been discussing the modified front of the tab facing in terms of the ribs 12 which is what I have on my prototype. However, other configurations or raised patterns can be used. It is believed that the raised patterns should have continuous raised surface from the back 34 to the front 36 of the face of the shooting tab or at least have no nicks or impediment to the bow string as it is released. This is so the movement of the bow string will not be slowed by notches or impediments in the pattern or ribs. The raised patterns whether it be the ribs, or other configurations, are what can be called herein as "lands". What I am obtaining here and teaching herein is to obtain a real smooth release with the least amount of string contact practical.

Figure 6:
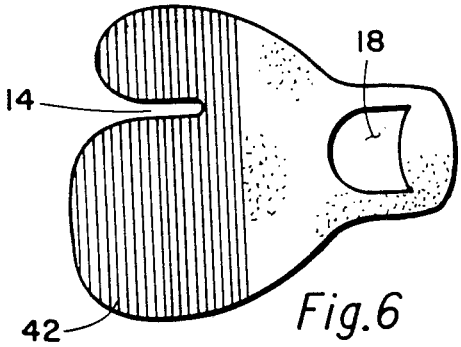
FIG. 6 illustrates the back of a tab facing.

If desired, I can modify the back of the tab facing 10 from the smooth surface previously used. This modification is shown in FIG. 6 which shows sides 38 with a plurality of slits and ribs 42. The slits 40 may or may not extend through the material but are provided to make the material more flexible. The slits or ribs 42 should be perpendicular to the ribs 12. A possible arrangement is to have the slits or ribs 1/16 inches apart with a depth of 0.002 to 0.005 inches. This improves flexibility.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A shooting tab for use with a bow having a string for shooting an arrow which comprises:

a finger loop with a finger hole;

a finger spacer having a surface with a longitudinal axis;

a tab facing with an arrow notch having a longitudinal axis;

means for securing said spacer and said tab facing in relation to each other such that the longitudinal axis of the notch is aligned with the longitudinal axis of said finger spacer and means for securing said finger loop to said tab facing;

said tab facing having a front and a back, said front contacting said string when said shooting tab is used, said front having lands which extend above the rest of the surface of said front, the surface area of said lands exposed to said string when used is not over about fifty percent of the area of said front.

2. A shooting tab as defined in claim 1 in which said lands are ribs which are essentially parallel to said longitudinal axis of said notch.

3. A shooting tab as defined in claim 1 including knife cuts into the back of said tab facing which are essentially perpendicular to the longitudinal axis of said arrow notch.

4. A shooting tab for use with a bow having a string for shooting an arrow which comprises:

a finger loop with a finger hole;

a tab facing secured to said finger loop, said tab facing having an arrow notch having a longitudinal axis therein, said facing having a front and a back, said front contacting said string when said shooting tab is used, said front having parallel ribs which are essentially parallel to said longitudinal axis of said arrow notch.

5. A shooting tab as defined in claim 4 in which said surface area of said ribs exposed to said string is about thirty-eight percent of the area of said front which the string would contact if the front were smooth.

6. A shooting tab as defined in claim 4 in which the area of the front of said tab facing exposed to the bow string is not over about fifty percent of what would be exposed to the bowstring if the surface of the front were smooth.

7. A shooting tab as defined in claim 5 in which said facing is made of a vinyl.

8. A shooting tab for use with a bow having a string for shooting an arrow which comprises:

a finger loop with a finger hole;

a tab facing with an arrow notch having a longitudinal axis;

means for securing said spacer and said tab facing in relation to each other such that the longitudinal axis of the notch is aliged with the longitudinal axis of said finger spacer and means for securing said finger loop to said tab facing;

said tab facing having a front and a back, said front contacting said string when said shooting tab is used, said front having lands which extend above the rest of the surface of said front, the surface area of said lands exposed to said string when used is not over about fifty percent of the area of said front.

9. A shooting tab as defined in claim 8 in which said surface area of said lands exposed to said string is not over about thirty-eight percent of the area of said front which the string would contact if the front were smooth.

* * * * *